US008672445B2

(12) United States Patent
Wall et al.

(10) Patent No.: US 8,672,445 B2
(45) Date of Patent: Mar. 18, 2014

(54) CAPPING DEVICE

(75) Inventors: John Wall, Fairview Heights, IL (US); Thomas Kimerling, Corvallis, OR (US); Casey Robertson, Romeoville, IL (US); Martin McNestry, Heanor (GB)

(73) Assignee: Videojet Technologies, Inc., Wood Dale, IL (US)

( * ) Notice: Subject to any disclaimer, the term of this patent is extended or adjusted under 35 U.S.C. 154(b) by 98 days.

(21) Appl. No.: 13/231,443

(22) Filed: Sep. 13, 2011

(65) Prior Publication Data

US 2013/0063519 A1 Mar. 14, 2013

(51) Int. Cl.
*B41J 2/165* (2006.01)
*B41J 2/175* (2006.01)

(52) U.S. Cl.
CPC ..... *B41J 2/165* (2013.01); *B41J 2/17536* (2013.01)
USPC ..... 347/29

(58) Field of Classification Search
CPC ..... B41J 2/165; B41J 2/17536; B41J 2/1754
USPC ..... 347/29, 32
See application file for complete search history.

(56) References Cited

U.S. PATENT DOCUMENTS 4,500,894 A * 2/1985 Kirner ..... 347/29
5,682,186 A 10/1997 Bohorquez
5,781,214 A 7/1998 Vonasek
5,798,777 A 8/1998 Yoshimura
5,805,181 A 9/1998 Tanaka
5,867,184 A 2/1999 Quintana
5,971,521 A 10/1999 Bainvel
6,045,216 A 4/2000 Sasaki
6,142,602 A * 11/2000 Tanaka ..... 347/29
6,196,658 B1 3/2001 Rhodes
6,209,983 B1 4/2001 Osborne
6,220,689 B1 4/2001 Sturgeon
6,260,943 B1 7/2001 Ishikawa (Continued)

FOREIGN PATENT DOCUMENTS

DE 102006004477 8/2007
EP 2300236 B1 3/2011
JP 05220967 A * 8/1993
WO 2009127194 10/2009

OTHER PUBLICATIONS

Machine generated English translation of written description of JP05-220967A to Kitahara, "Ink Jet Head"; generated via http://www.ipdl.inpit.go.jp/homepg_e.ipdl on May 28, 2013; 4 pp.*

*Primary Examiner* — Shelby Fidler
(74) *Attorney, Agent, or Firm* — Joseph A. Yosick

(57) ABSTRACT

A capping device for an ink jet print head includes a base configured to receive an ink jet print head and a cap assembly attached to the base. The cap assembly is configured for sliding movement with respect to the base to provide a closed position of the cap assembly when the print head is not printing and an open position to allow for the ejection of ink from nozzles when the print head is printing. The cap assembly includes a cover support and a cover attached to the cover support in a generally planar relationship thereto. The cover is adapted to provide additional movement with respect to the cover support in a direction different from the sliding direction. The cover includes a rigid mating surface configured to engage a surface of the print head adjacent the nozzles.

16 Claims, 9 Drawing Sheets

(56) References Cited

U.S. PATENT DOCUMENTS

| | | | | |
|---|---|---|---|---|
| 6,305,779 | B1 | 10/2001 | Capurso | |
| 6,406,123 | B1 | 6/2002 | Usui | |
| 6,471,329 | B1 | 10/2002 | Maza | |
| 6,623,098 | B2 | 9/2003 | Davis | |
| 6,726,306 | B2 | 4/2004 | Keyes | |
| 6,837,636 | B2 | 1/2005 | Sawyer | |
| 6,918,649 | B2 | 7/2005 | Silverbrook | |
| 7,029,091 | B2 | 4/2006 | Stellbrink | |
| 7,334,863 | B2 | 2/2008 | Nishi | |
| 7,344,220 | B2 | 3/2008 | Moynihan | |
| 7,669,947 | B2 | 3/2010 | Bradford | |
| 7,883,174 | B2 | 2/2011 | Wheeler | |
| 7,984,962 | B2 | 7/2011 | Berry | |
| 8,100,503 | B2 | 1/2012 | Berry | |
| 2002/0080208 | A1* | 6/2002 | Miyauchi et al. | 347/32 |
| 2003/0043226 | A1* | 3/2003 | Balcan et al. | 347/32 |
| 2003/0076376 | A1 | 4/2003 | Greeven | |
| 2004/0246296 | A1* | 12/2004 | Nakashima | 347/32 |
| 2006/0103690 | A1* | 5/2006 | Katayama | 347/29 |
| 2008/0204503 | A1* | 8/2008 | Studer et al. | 347/23 |
| 2008/0211864 | A1* | 9/2008 | Mealy et al. | 347/33 |
| 2009/0147042 | A1 | 6/2009 | McAvoy | |

* cited by examiner

CAPPING DEVICE

BACKGROUND

The present disclosure relates to a capping device for an ink jet printer.

Thermal ink jet printers are commonly used to print on stationary substrates such as paper, as well as objects that may move past the print head such as cartons, boxes, and other types of primary and secondary packaging. A common problem with thermal ink jet printers is that when the print head is not being used, inks tend to dry out and clog the nozzles of the print head. A common approach to prevent this nozzle clogging has been to use some sort of capping device to seal the area around the nozzles. Prior devices frequently use a non-contact, molded or machined pocket over the nozzle orifices. In these designs, the pocket around the nozzle orifices needs to remain saturated with fluid to remain non-drying, and any deviation from planarity between the cap and the pocket allows air into the pocket which causes drying of the fluid and loss of print capability. Other prior devices, particularly those used for desktop printers, require the print head to be moved to a maintenance station when not printing. This requires additional components to move the print head and slows the process of capping and decapping.

BRIEF SUMMARY

The present disclosure provides a capping device for an ink jet printer that provides a cover for directly engaging the nozzle area of the print head to reduce solvent evaporation of the print head nozzles and minimize blocking and clogging of the print head nozzles. The device allows the print head to print after a capped period with minimal loss of print quality. The disclosed device is also capable of automatically capping and de-capping at high speeds to avoid missing print on the product each time the production line is stopped and started and during periods when no product is detected. The disclosed device is also an improvement over maintenance style caps, as the print head does not need to move from its printing position, thus allowing for faster capping and de-capping times.

In one aspect, a capping device for an ink jet print head includes a base configured to receive an ink jet print head and a cap assembly attached to the base. The cap assembly is configured for sliding movement with respect to the base to provide a closed position of the cap assembly when the print head is not printing and an open position to allow for the ejection of ink from nozzles when the print head is printing. The cap assembly includes a cover support and a cover attached to the cover support in a generally planar relationship thereto. The cover is adapted to provide additional movement with respect to the cover support in a direction different from the sliding direction. The cover includes a rigid mating surface configured to engage a surface of the print head adjacent the nozzles.

In another aspect, a method of operating a capping device for an ink jet print head includes providing a base, the base configured to receive an ink jet print head. A cap assembly includes a cover support and a cover attached to the cover support in a generally planar relationship thereto. The cap assembly is moved in a sliding movement with respect to the base to provide a closed position of the cap assembly when the print head is not printing and an open position to allow for the ejection of ink from nozzles when the print head is printing. The cover is moved in a direction different from the sliding direction and engages a rigid mating surface of the cover with a surface of the print head adjacent the nozzles.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
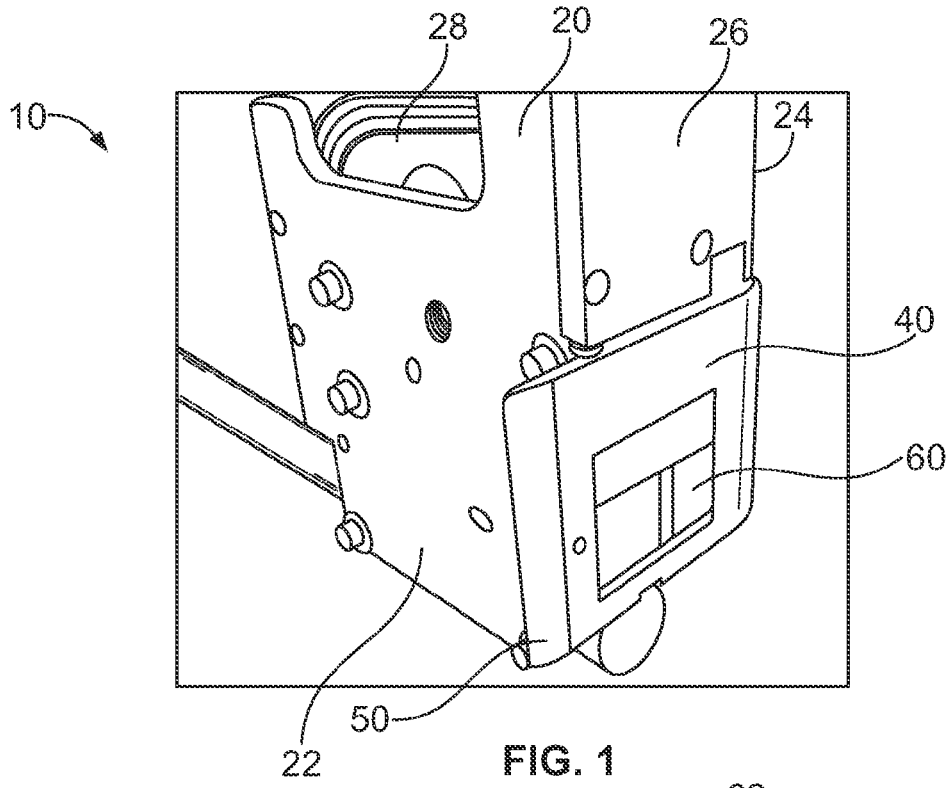
FIG. 1 shows a first embodiment of a capping device.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides a capping system for an ink jet printer. In particular, it provides a capping system for a thermal ink jet printer that covers the nozzle array when the printer is not printing to prevent the nozzles from drying out. The capping system provides a floating cover that provides a rigid surface to contact and seal the nozzle array when the printer is not printing A first embodiment of the capping device 10 is shown in FIG. 1. The capping device 10 includes a pocket or base 20. The base 20 is configured to receive an ink cartridge 28 with an ink jet print head 30 (not shown). The ink jet print head 30 is adapted to eject ink droplets in a controlled manner to print an image on a substrate. The ink cartridge 28 may include an ink reservoir. The base 20 serves as a holding device for the print head 30 and may include various electrical connections and the like for controlling operation of the cartridge 28. The base 20 generally includes side walls 22, 24 and bottom wall or face plate 26. It should be noted that the direction 'bottom' is used for convenience and the bottom wall 26 may be oriented in a side or other direction. An example of a print head and a base are described in U.S. Patent Application No. US20090303299A1, titled "INK CONTAINMENT SYSTEM AND INK LEVEL SENSING SYSTEM FOR AN INK-JET CARTRIDGE," the contents of which are incorporated by reference herein. However, the capping systems as described herein is suitable for use with a variety of printing systems, and are particularly useful for thermal ink jet print heads, particularly those using organic solvent-based inks.

Figure 2:
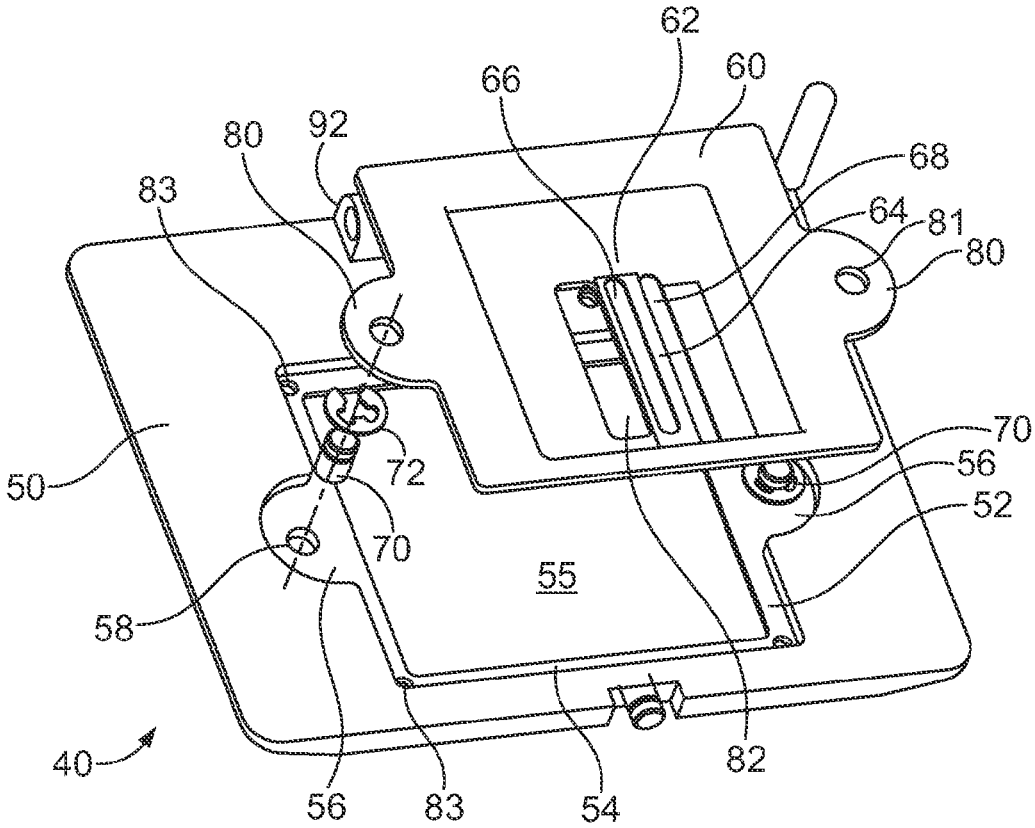
FIG. 2 is a partially exploded perspective view of the back side of an embodiment of a cap assembly.

As shown in FIGS. 1 and 2, a cap assembly 40 is attached to the base 20. The cap assembly 40 includes a cover support 50 configured for sliding movement with respect to the base 20 to provide a closed position when the print head 30 is not printing and an open position to allow for the ejection of ink when the print head 30 is printing. A cover 60 is attached to the cover support 50 in a generally planar relationship thereto. The cover 60 includes a rigid mating surface 62 to engage a portion of the print head 30. Mating surface 62 made by made from a rigid material such as metal; in particular, steel, especially stainless steel, is preferred. In particular, when the cap assembly 40 is in a closed position, the mating surface 62 seals the nozzles of the print head 30 to slow or prevent drying of the ink and subsequent blocking or plugging of the nozzles by the dried ink.

FIG. 2 shows the back side (side facing the print head 30) of cap assembly 40. Cover support 50 may be generally rectangular in shape. Disposed within cover support 50 is an inner frame 52. The inner frame 52 serves as an engagement surface for cover 60 and corresponds in shape to cover 60. In particular, inner frame 52 includes an indented ledge 54 disposed around the periphery of an opening 55, and semicircular areas 56 with holes 58 disposed at opposite sides of the opening 55. Ledge 54 and semicircular areas 56 are configured to correspond to the shape of cover 60 and accommodate the cover 60 thereto. Posts 70 are disposed in holes 58, and along with clips 72 serves to secure cover 60 to cover support 50. Cover 60 is capable of sliding up and down on posts 70 with respect to cover support 50, thus providing limited travel in the print or ink ejection direction during opening and closing of the cap assembly 40. The cover 60 includes a print window 82 for positioning over nozzles of the print head 30 when the capping device 10 is in an open or print position.

Cover 60 may include semicircular tabs 80 with holes 81. Tabs 80 preferably correspond in shape to semicircular areas 56. Posts 70 may be inserted in and affixed to holes 81. This connection allows the cover 60 to provide movement in a direction different from the sliding direction. The direction different from the sliding direction may be generally perpendicular to the sliding direction. The cover 60 may move a distance in the perpendicular direction that is small relative to the movement in the sliding direction. For example, the distance traveled by the cover in the perpendicular direction may be less than 25%, 20%, or 15% of the distance traveled by the cover 60 in the sliding direction. In one embodiment, the movement in a direction different from the sliding direction is rotational movement with respect to the cover support 50, as will be described in more detail below. The cover 60 may further be attached to the cover support 50 by at least one spring 85 (seen in FIGS. 5-7). The springs 85 may be attached to holes 83 in the corners of inner frame 52 and thence to the corresponding corners of cover 60. Springs 85 bias the cover 60 toward the cover support 50 and thus toward the print head 30. Cover 60 is capable of sliding up and down on posts 70 with respect to cover support 50.

Figure 3:
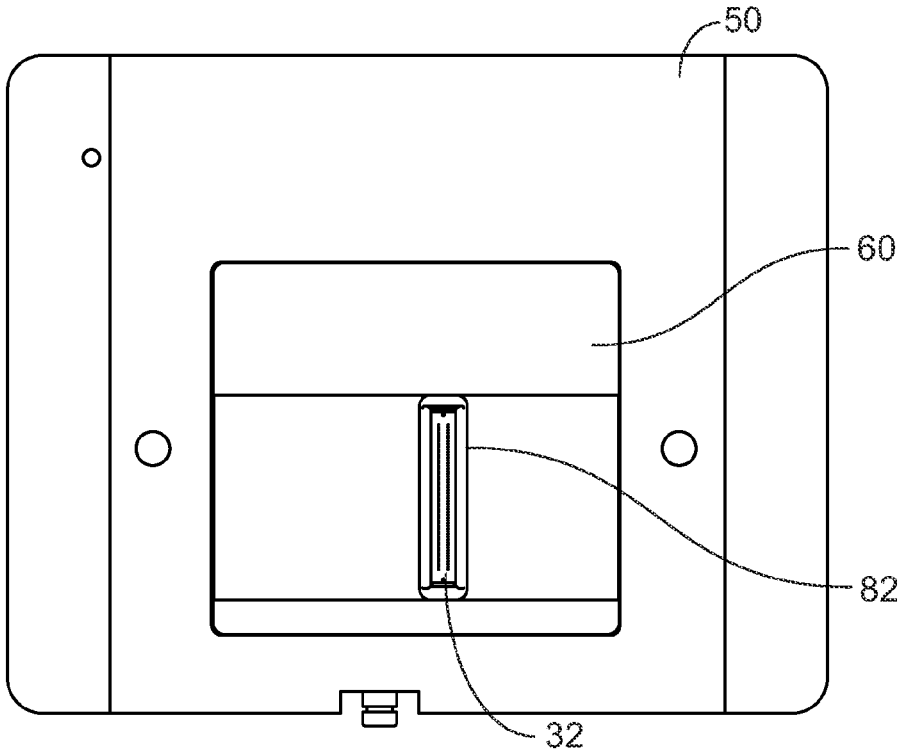
FIG. 3 is a view of the cap assembly of FIG. 2 in an open position.
Figure 4:
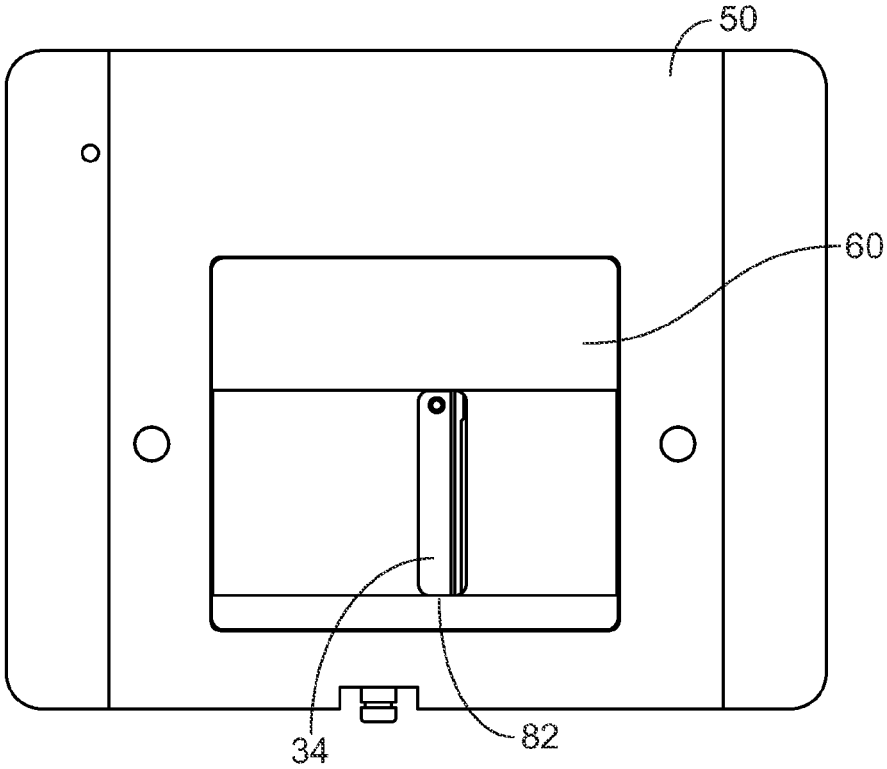
FIG. 4 is a view of the cap assembly of FIG. 2 in a closed position.

The cover 60 is disposed generally parallel to a nozzle surface (a surface adjacent the nozzles) of the print head 30 when the cap assembly 40 is an open and closed position. FIG. 3 shows the cap assembly 40 in a closed position and FIG. 4 shows the cap assembly 40 in an open position. In FIG. 3, the nozzle array 32 of the print head 30 can be seen through the window 82 in cover 60. As the cap assembly 40 is moved in a lateral (left-to-right) direction (perpendicular to the nozzle ejection directions) in FIG. 4, it can be seen that the nozzle array 32 is no longer exposed in window 82. Instead, a portion of the print head face 34 adjacent to the nozzle array 32 is visible through the window 82. In a preferred configuration, the lateral movement of cap assembly 40 (including cover 60) with respect to base 20 may be in the range of about 0.1 to 0.5 inches, preferably less than 0.5 inches, and more preferably less than 0.25 inches.

Figure 5A:
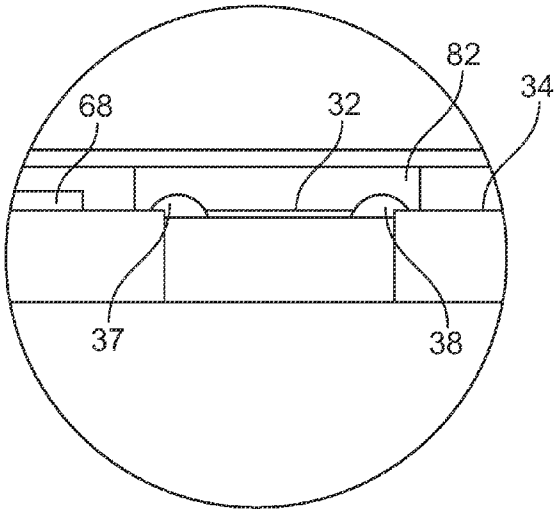
FIG. 5A is an enlarged view of the cap of FIG. 5.
Figure 6A:
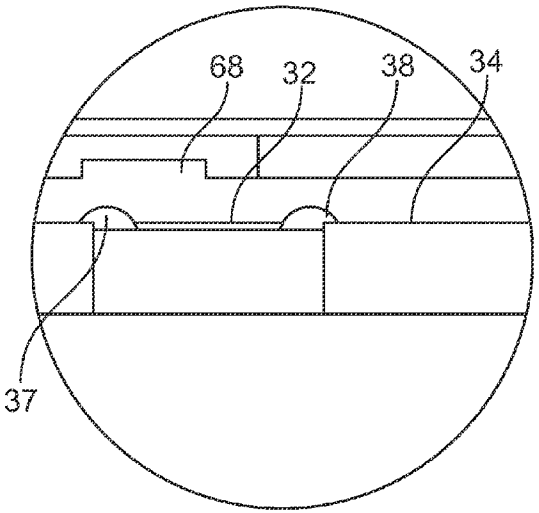
FIG. 6A is an enlarged view of the cap of FIG. 6.
Figure 5:
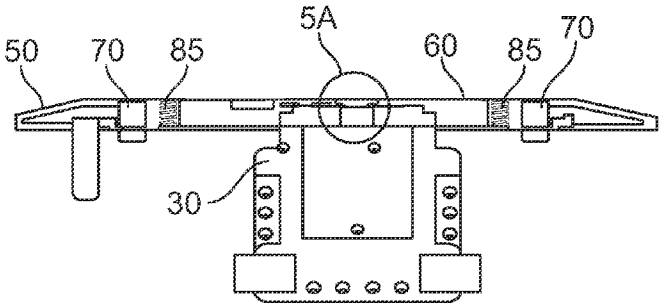
FIG. 5 is a sectional view showing the cap of the capping device of FIG. 1 in an open position.
Figure 6:
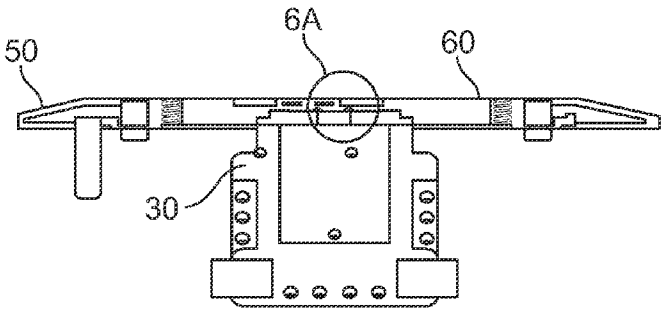
FIG. 6 is a sectional view showing the cap of the capping device of FIG. 1 between an open position and a closed position.

As shown in FIGS. 5, 5A, 6, 6A, 7, and 7A, the mating surface 62 of cover 60 includes features to engage the print head 30. When the cap assembly 40 is in the open position, as shown in FIG. 5A, nozzle array 32 is disposed in window 82. Print head 30 is capable of ejecting ink from nozzles array 32 through the window 82. Ridges or beads 37, 38 may flank the length of nozzle array 32. FIGS. 6 and 6A show the cap assembly 40 between an open and closed position. Cover 60 is disposed farther away from the face 34 of the print head 30 in this position, than when the cover 60 is in the fully open or fully closed position, to allow clearance over features of the print head face 34, including nozzle array 32.

Figure 7A:
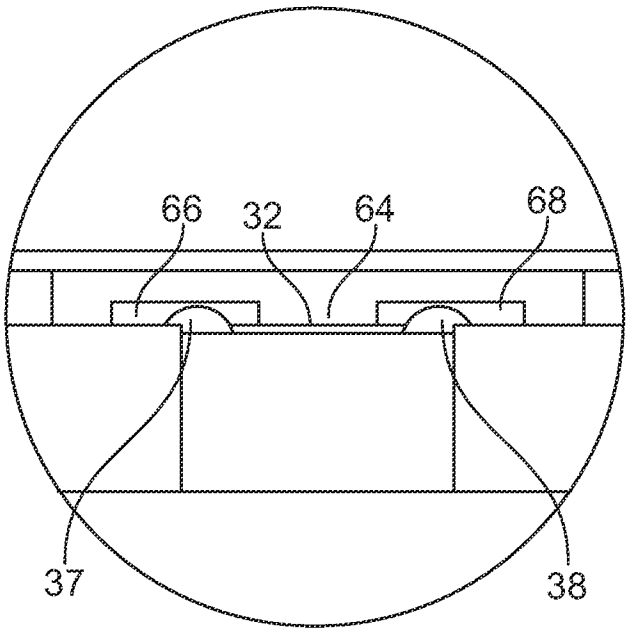
FIG. 7A is an enlarged view of the cap of FIG. 7.
Figure 7:
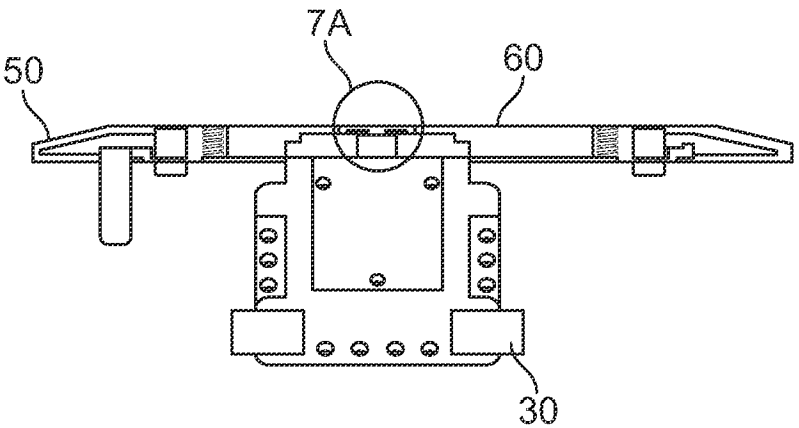
FIG. 7 is a sectional view showing the cap of the capping device of FIG. 1 in a closed position.

FIGS. 7 and 7A show the cover 60 in a closed position. As best seen in FIG. 7A, in one embodiment, the mating surface 62 includes a ridge 64 for directly covering the nozzle array 32 of the print head 30. As also seen in FIG. 2, the ridge 64 may be framed by slots or channels 66, 68. Slots 66, 68 are shallow elongated depressions that are configured to engage features on the face of the print head. In one embodiment, when the cap assembly 40 is in the closed position, ridge 37 is disposed in slot 66 and ridge 38 is disposed in slot 68; thus, slot 66 engages ridge 37 on the print head and slot 68 engages ridge 38 on the print head, with ridge 64 preferably directly touching nozzle array 32.

Ridges 37, 38 of print head 30 are disposed adjacent to the print window 82 when the cap assembly 40 is in the open position. With horizontal movement of the cover 60, ridges 37, 38 may urge the cover 60 generally upward (or in the ink projecting direction) during movement between the open and closed positions. The movement of cover 60 in the ink projecting direction with respect to base 20 may be in the range of about 0.01 to 0.05 inches, preferably less than 0.05 inches, and more preferably less than 0.04 inches. Thus, the movement of the cover 60 in the ink projecting direction is generally small (around 10% to 30%) relative to the horizontal movement of the cover 60 with respect to the base 20. Channels 66, 68 accommodate features of the print head 30. In particular, the channels 66, 68 engage the print head features 37, 38 when the cap assembly 40 is moved between an open position and a closed position. The springs 85 between the cover 60 and the cover support 50 bias the cover 60 toward the print head 30 so the cover 60 is substantially flush with the face 34 of the print head 30 when in the closed position.

The biased connection between cover 60 and cap assembly 40 allows the cover 60 to float with respect to the print head 30 to adjust the planar relationship between the cover 60 and the surface of the print head 30; thus, any slight imperfection in alignment between the cover 60 and print head 30 does not prevent a good seal from forming, because the planarity of cover 60 adjusts with respect to the print head 30 to provide for such imperfections. The rigid mating surface 62 is configured to directly engage a surface of the print head 30. The rigid mating surface 62 preferably directly engage the surface of nozzle array 32. Thus, unlike prior art devices, it does not require a flexible or elastomeric material to seal the cover 60 against the nozzle array 32, or a saturated pocket surrounding the nozzle array 32.

Figure 8:
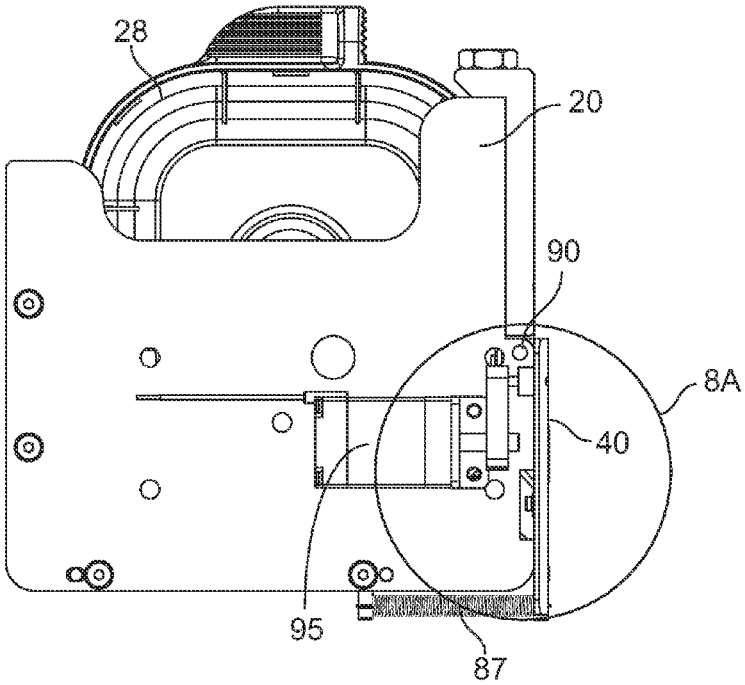
FIG. 8 is a sectional view showing the cap of the capping device of FIG. 1 in a closed position.
Figure 8A:
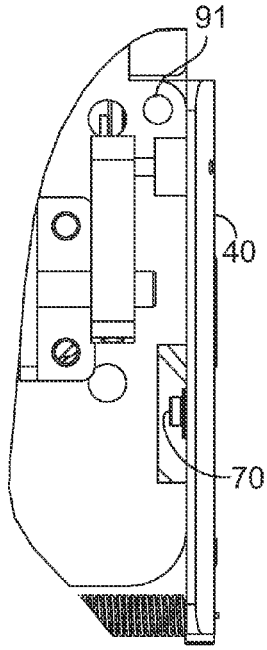
FIG. 8A is an enlarged view of the circled portion of FIG. 8.
Figure 9:
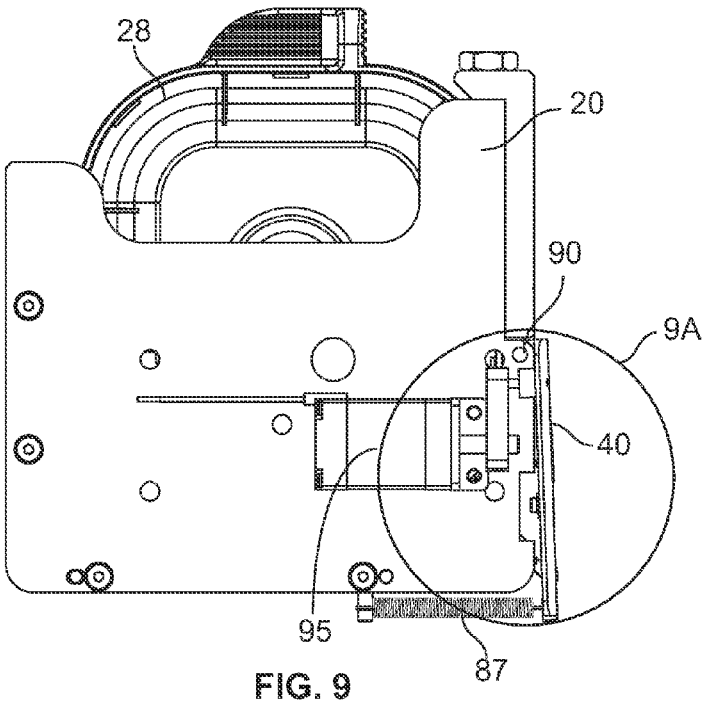
FIG. 9 is a sectional view showing the cap of the capping device of FIG. 1 between an open position and a closed position.
Figure 9A:
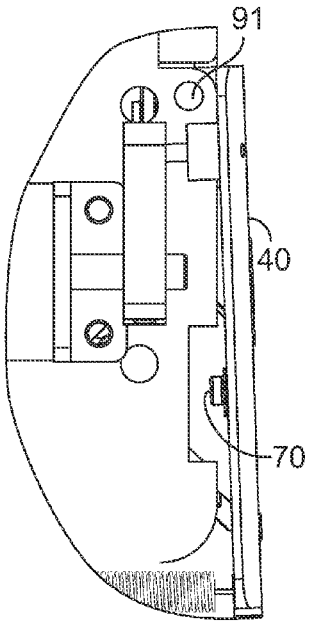
FIG. 9A is an enlarged view of the circled portion of FIG. 9.

The capping device 10 may include a mechanism for rotational movement of the cap assembly 40 with respect to the base 20. FIG. 8 is a side view showing the cap assembly 40 in a closed position and FIG. 9 shows the cap assembly between an open and closed position. As shown in FIGS. 8, 8A, 9, and 9A, cap assembly 40 includes a hinge 90. The hinge 90 may be any suitable design; in one embodiment, it includes pin 91 disposed in anchor portion 92 on cap assembly 40. A return spring 87 urges the cap assembly 40 towards the base 20. Hinge 90 permits the cap assembly 40 to rotate slightly with respect to the base 20 when moving between a capped and uncapped position, to prevent any damaging contact between the mating surface 62 and the print head face 34 or nozzle array 32. A ball detent may be used to lift the cap assembly 40 away from the base 20 during opening and closing of the cap assembly 40. This movement of the cap assembly 40 with respect to the base 20 between the open and closed position is preferably less than a 5°, 4°, 3°, or 2° angle of rotation of the cap assembly 40 with respect to the base 20. In one embodiment, this movement is about a 1° angle of rotation of the cap assembly 40 with respect to the base 20.

The cap assembly 40 may be controlled and moved or actuated by any suitable mechanism. In one embodiment, the assembly includes a drive mechanism 95 for actuating the cover support 50. The drive mechanism 95 may be similar to that disclosed below with respect to a second embodiment of a capping device.

Figure 10:
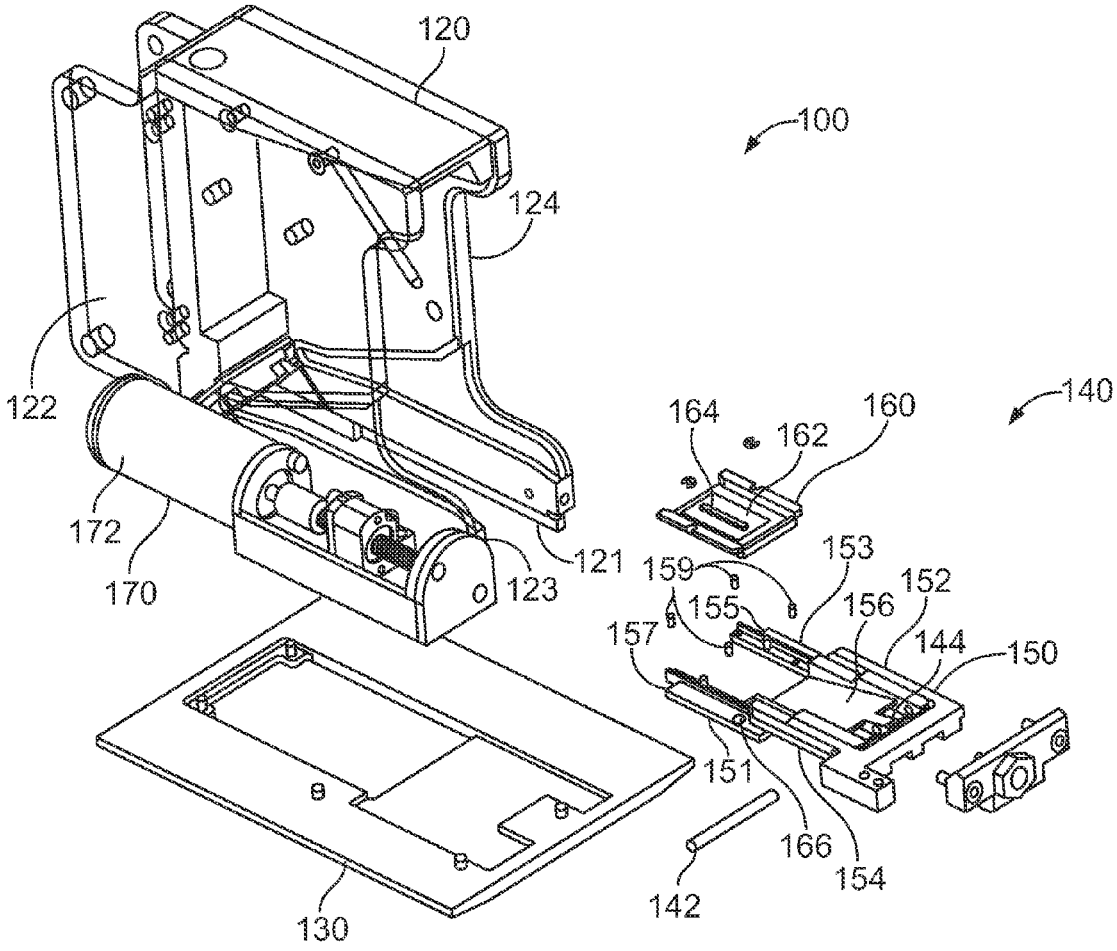
FIG. 10 is an exploded view of the components of a second embodiment of a capping device.
Figure 11A:
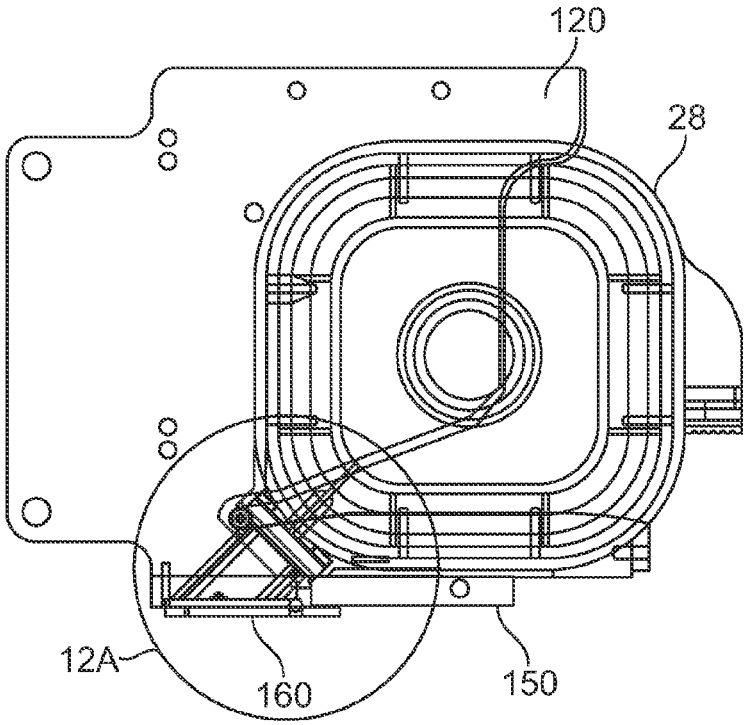
FIG. 11A is a sectional view of the second embodiment of the capping device in a closed position.
Figure 11B:
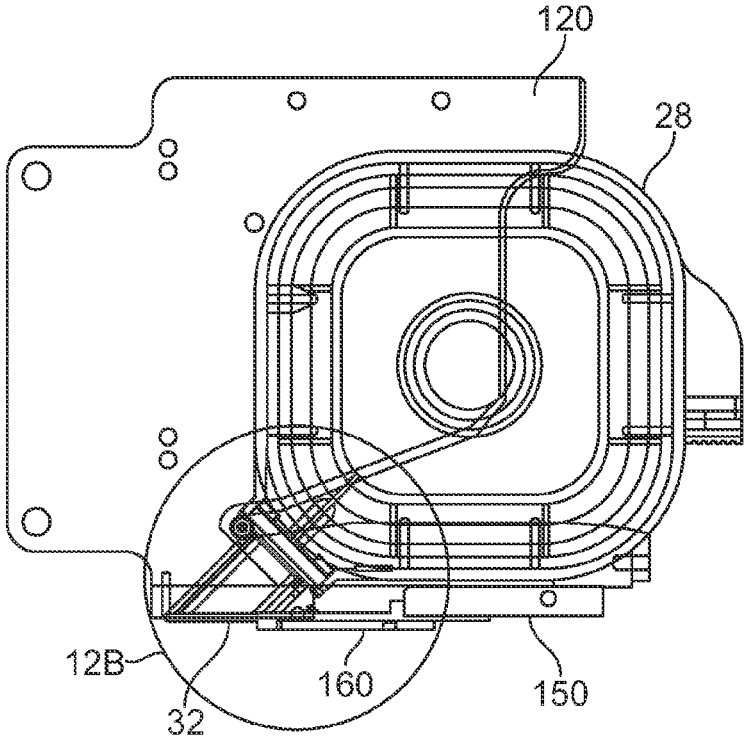
FIG. 11B is a sectional view of the second embodiment of the capping device in an open position

A second embodiment of the capping device 100 is shown in exploded view in FIG. 10. The capping device 100 includes a pocket or base 120. The base 120 is configured to receive an ink cartridge 28 with an ink jet print head 30 (shown in FIGS. 11A and 11B). Like base 20, base 120 also serves as a holding device for the print head 30 and may include various electrical connections and the like. The base 120 generally includes side walls 122, 124 and face plate 130. As shown in FIG. 10, a cap assembly 140 is attached to the base 120. The cap assembly 140 includes a cover support 150 configured for sliding movement with respect to the base 120 to provide a closed position when the print head 30 is not printing and an open position to allow for the ejection of ink when the print head 30 is printing. Cover support 150 may be generally U-shaped with arms 152 and 154 extending around cap frame 156. Cap frame 156 includes arms 151 and 153 and is hingedly attached to cover support 150. In one embodiment, pin 142 extends through portions of cover support 150 and end of cap frame 156 to provide the hinged connection. The cap assembly 140 includes a biasing mechanism 144 for urging the cover 160 towards the print head 30. Biasing mechanism 144 may be one or more return springs.

A cover 160 is attached to the cover support 150 at arms 151 and 153 and is in a generally planar relationship with respect to the cover support 150. Springs 159 or other biasing mechanisms are disposed between cover 160 and cover support 150 to allow the cover to float with respect to the cover support 150. The biased connection between cover 160 and cover support 150 preferably allows the cover 160 to float with respect to the print head 30 to adjust the planar relationship between the cover 160 and the surface of the print head; thus, any slight imperfection in alignment between the cover 160 and print head 30 does not prevent a good seal from forming, because the planarity of cover 160 adjusts with respect to the print head 30 to provide for such imperfections. The cover 160 includes a rigid mating surface 162 to engage a portion of the print head 30. In particular, when the cap assembly 140 is in a closed position, the mating surface 162 seals the nozzles of the print head 130. Mating surface 162 may include a ridge 164 adapted to contact the nozzle array 32.

Figure 12A:
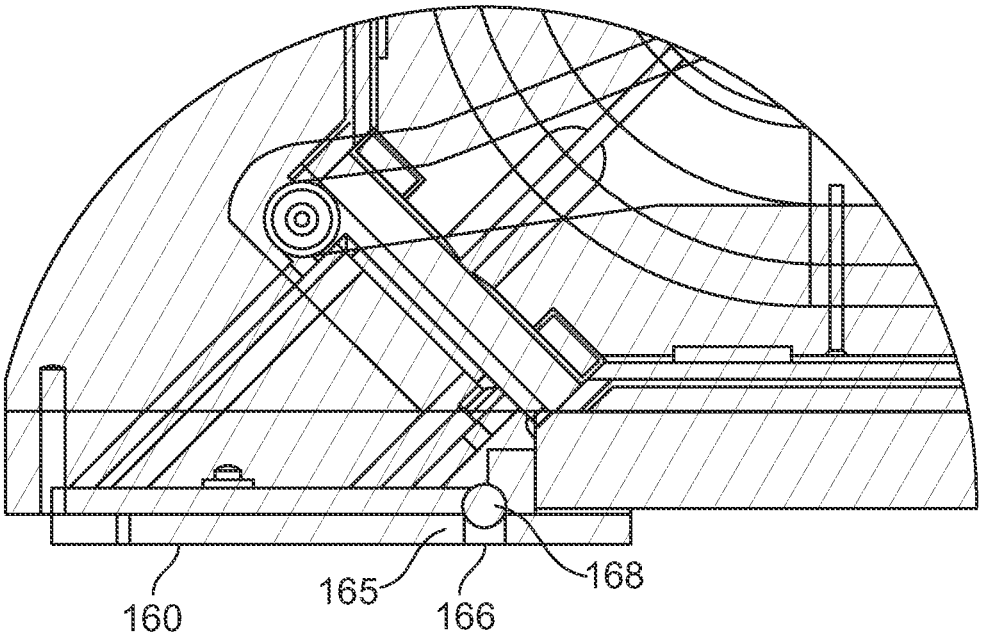
FIG. 12A is an enlarged view of area 12A of FIG. 11A.
Figure 12B:
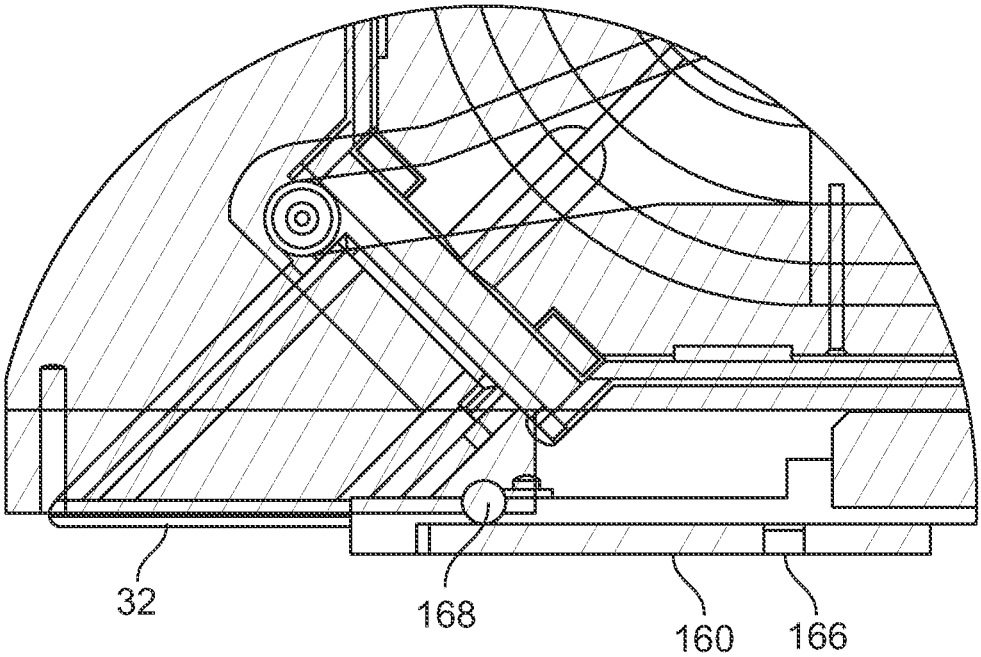
FIG. 12B is an enlarged view of area 12B of FIG. 11B.

The biasing mechanism 144 rotates the cover 160 with respect to the cover support when the cap assembly 140 is moved between an open position and a closed position. As shown in FIGS. 11A, 11B, 12A and 12B, in one embodiment, the cover support 150 and the base 120 include a detent system 165 with hole 166 and ball 168 for urging the cover 160 away from the base 120 when the cap assembly 140 is moved between an open position and a closed position. One or more ball detents 165 are mounted on a surface of the base 120 and engage a surface of the cover 160, when the cover 160 is moving between the open and closed positions. In particular, base 120 include at least one ball 168 adjacent the portion of the base 120 that contacts cover 160 and cover 160 includes a corresponding aperture 166. As shown in FIG. 12A, in the closed position, ball 168 is in mating relationship with the aperture 166, and the spring 144 biases the cover 160 towards the print head. As shown in FIG. 12B, when the cover 160 is moved to the open position, ball 168 urges the cover 160 slightly downward and at angle with respect to base 120.

The base 120 or faceplate 130 and cover support 150 include a slide mechanism to enable the cover support 150 and cover 160 to slide with respect to the base 120 and print head 30. In one embodiment, cover support 150 includes flanges 155, 157 adjacent arms 151, 153, which extend laterally from the cover support 150 and are configured to be disposed in channels 121, 123 in base 120. Other mechanical arrangements are of course possible to permit the cover support 150 to slide with respect to the base 120, such as rails, channels, arms, rack and pinion, and the like.

Figure 13A:
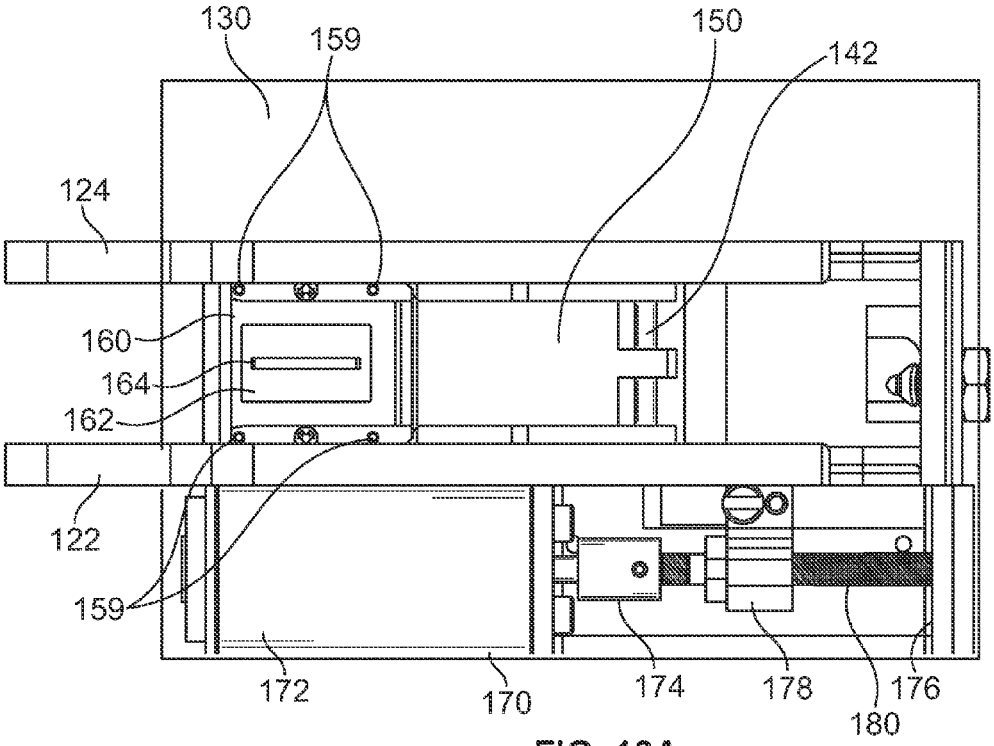
FIG. 13A is a top view showing the cap of the capping device of FIG. 10 in a closed position.
Figure 13B:
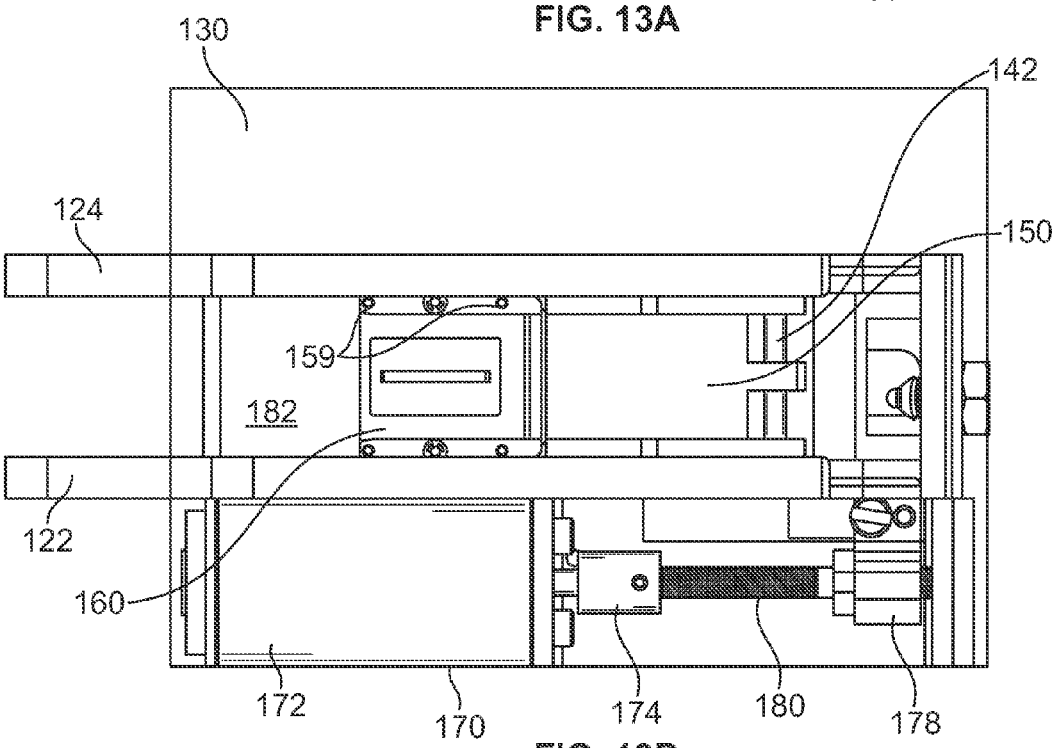
FIG. 13B is a top view showing the cap of the capping device of FIG. 10 in an open position.

As shown in FIGS. 13A and 13B, the assembly may include a drive mechanism 170 for actuating the cover support 150. The drive mechanism may include a motor 172 for causing sliding movement of the cover support 150. The motor may be a stepper motor. Motor 172 turns screw 180 which causes linear movement of driver 178, which is connected to cover support 150. Stops 174, 176 may be disposed at opposite ends of screw 180 to limit travel of the cover support 150 with respect to the base 120. In the open position, a window 182 is provided for ejection of ink form the print head 32 to a substrate. The operation of cap assembly 100 may be provided by mechanisms known in the art, such as electronic controllers, computers, and the like. The control may be integrated with a production line, for example, to providing closing of the cap assembly 100 when print head 30 is not being used for printing. Movement of the cap assembly 100 may also be integrated with various maintenance operations for the print head 30, such as spitting, wiping, and cleaning.

The disclosed capping devices 10 and 100 allow the print head 30 to print after a capped period with minimal loss of print quality. The disclosed devices are also capable of automatically capping and de-capping at high speeds to avoid missing print on the product each time the production line is stopped and started and during periods when no product is detected. The uncap time (defined as the time it takes for the capping device to move from a closed position to an open position) is preferably less than 100 milliseconds, 50 milliseconds, or 25 milliseconds. A printing system with the capping device can preferably print on a piece of media (such as a package) traveling at a speed of at least 5 ft/sec using a product detect sensor no further than 2 inches upstream of the printhead. To achieve this, the uncap time needs to be 33 milliseconds or faster. The disclosed embodiments were capable of achieving uncap and cap times of around 20 milliseconds. The disclosed devices do not need the print head to move from its printing position, thus allowing for faster capping and de-capping times. Although the disclosed embodiments are generally described with respect to a thermal ink jet print head, it is apparent that they may also be used with other types of printers, such as piezo based drop on demand printers and the like. The various components of the capping devices 10 and 100 may be made of any suitable material; stainless steel is a preferred material.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A capping device for an ink jet print head, comprising:

a base, the base configured to receive an ink jet print head comprising nozzles, the base comprising a faceplate;

a cap assembly attached to the base and configured for sliding movement with respect to the base and the faceplate to provide a closed position of the cap assembly when the print head is not printing and an open position to allow for the ejection of ink from the nozzles when the print head is printing, the cap assembly comprising:

a frame;

a cover support hingedly attached to the frame;

a cover attached to the cover support in a generally planar relationship thereto, wherein the cover is adapted to provide additional movement with respect to the cover support in a direction different from the sliding direction, wherein the cover is able to float with respect to the surface of the print head to adjust the planar relationship between the cover and the surface of the print head, and wherein the cover comprises a rigid mating surface configured to engage a surface of the print head adjacent the nozzles; and a biasing mechanism for urging the cover towards the nozzles of the print head in the ink ejection direction.

2. The capping device of claim 1 wherein the mating surface comprises features to engage the print head.

3. The capping device of claim 1 wherein the mating surface comprises a ridge for covering an area above the nozzles of the print head.

4. The capping device of claim 1 wherein the direction different from the sliding direction is generally perpendicular to the sliding direction.

5. The capping device of claim 1 wherein the movement in a direction different from the sliding direction is rotational movement with respect to the base.

6. The capping device of claim 1 wherein the cover is disposed parallel to the surface of the print head when the cap assembly is in the open position and when the cap assembly is in the closed position.

7. The capping device of claim 1 wherein the rigid mating surface is configured to directly contact the surface of the print head.

8. The capping device of claim 1 the biasing mechanism rotates the cover with respect to the base when the cap assembly is moved between the open position and the closed position.

9. The capping device of claim 1 wherein the cover support and the base comprise a detent system for urging the cover away from the base when the cap assembly is moved between the open position and the closed position.

10. The capping device of claim 1 wherein the base comprises a slot and the cap assembly comprises a flange adapted to slide in the slot to provide the sliding movement.

11. The capping device of claim 1 further comprising a drive mechanism for actuating the cover support, the drive mechanism comprising:

a motor for causing sliding movement of the cover support, and first and second stops for limiting travel of the cover support with respect to the base.

12. The capping device of claim 1 wherein the cover is attached to the cover support by at least one spring.

13. The capping device of claim 1 wherein the cover comprises a print window for positioning over nozzles of the print head when the capping device is in the open position.

14. The capping device of claim 13 wherein the mating surface comprises first and second channels for accommodating features of the print head, wherein the first and second channels engage the print head features when the cap is moved between the open position and the closed position.

15. The capping device of claim 14 wherein in the closed position, the first channel engages a first ridge on the print head and the second channel engages a second ridge on the print head.

16. The capping device of claim 15 wherein the base further comprises a ridge, wherein in the open position, the first channel engages the ridge on the ridge of the base.

* * * * *